US006838607B2

(12) United States Patent
Elliot et al.

(10) Patent No.: US 6,838,607 B2
(45) Date of Patent: Jan. 4, 2005

(54) MOTORIZED PERCUSSION DEVICES

(75) Inventors: Daniel J. Elliot, Woodland Hills, CA (US); George T. Foster, Long Beach, CA (US)

(73) Assignee: Elliot Rudell, Torrance, CA (US)

( * ) Notice: Subject to any disclaimer, the term of this patent is extended or adjusted under 35 U.S.C. 154(b) by 0 days.

(21) Appl. No.: 09/797,073

(22) Filed: Feb. 28, 2001

(65) Prior Publication Data

US 2002/0117041 A1 Aug. 29, 2002

(51) Int. Cl.[7] ..... G10D 13/02

(52) U.S. Cl. ..... 84/422.4; 84/600; 84/422.1; 84/422.2

(58) Field of Search ..... 84/600, 645, 94.1–94.2, 84/95.1–95.2, 418, 422.1, 422.2, 422.3, 422.4; 446/297–298

(56) References Cited

U.S. PATENT DOCUMENTS 4,346,637 A * 8/1982 Janszen ..... 84/418
4,904,222 A * 2/1990 Gastgeb et al. ..... 84/422.4 X
5,323,678 A * 6/1994 Yould ..... 84/418
5,587,545 A * 12/1996 Nakada et al. ..... 84/600
5,760,318 A * 6/1998 Yang ..... 84/95.2
5,763,796 A * 6/1998 Britto et al. ..... 84/95.2
5,814,749 A * 9/1998 Sui et al. ..... 84/600
5,925,838 A * 7/1999 Meng-Suen ..... 84/404 X
6,028,260 A * 2/2000 LaLonde ..... 84/422.4
6,049,031 A * 4/2000 Caulkins ..... 84/645 X
6,201,173 B1 * 3/2001 Black ..... 84/422.1
6,273,781 B1 * 8/2001 Yamasaki ..... 446/298 X

* cited by examiner

*Primary Examiner*—Marion T. Fletcher
(74) *Attorney, Agent, or Firm*—Irell & Manella LLP

(57) ABSTRACT

Vibrating musical devices including a motorized drumstick that can generate and/or distort sound when placed into contact with a surface. For example, the motorized drumstick can generate a "buzz roll" on a drum or other resonating surface. The drumstick includes a rod that is attached to a handle. Located within the handle is a motor that can create an oscillating movement of the rod. The oscillating movement may be induced by an off-center weight that is attached to the motor. The motor and weight may be incorporated into other musical devices.

10 Claims, 3 Drawing Sheets

MOTORIZED PERCUSSION DEVICES

BACKGROUND OF THE INVENTION

1. Field of the Invention

The present invention relates to vibrating musical devices.

2. Background Information

Various musical instruments have developed over time from early drums to modern day synthesizers. New instruments may provide unique sounds that can be used to compose and play music. Certain instruments such as guitars and keyboards have been designed to incorporate electrical components to amplify and/or distort sound. For example, electric guitars can be coupled to a distortion box to distort the sound from the guitar.

To date, there have been limited modifications of drums, drum sets and drumsticks. U.S. Pat. No. 5,965,834 issued to Suenaga et al. discloses the concept of integrating transducers into cymbals. Suenaga has also developed electronic drum pads.

U.S. Pat. No. 5,341,716 issued to Petillo; U.S. Pat. No. 5,179,237 issued to Grossman; and U.S. Pat. No. 6,118,061 issued to Signor all disclose improved drumsticks with different materials, shapes, etc. These devices still require the user to strike a surface to generate a sound. It would be desirable to provide an active drumstick that can generate and/or distort sound. Additionally, it would be desirable to provide a mechanism that can generate and/or distort sound emitted from a musical instrument.

BRIEF SUMMARY OF THE INVENTION

One embodiment of the present invention is a musical device that includes a motor which induces an oscillating movement in an instrument housing.

DETAILED DESCRIPTION OF THE PREFERRED EMBODIMENT

In general the present invention includes a vibrating musical device. Musical devices include percussion instruments and devices. By way of example, the instrument may be a motorized drumstick that can generate or distort sound when placed in contact with a surface. For example, the motorized drumstick can generate a "buzz roll" on a drum or other resonating surface. The drumstick includes a rod that is attached to a handle. Located within the handle is a motor that can create an oscillating movement of the rod. When placed in contact with a surface the oscillating movement of the rod generates a sound.

Figure 1:
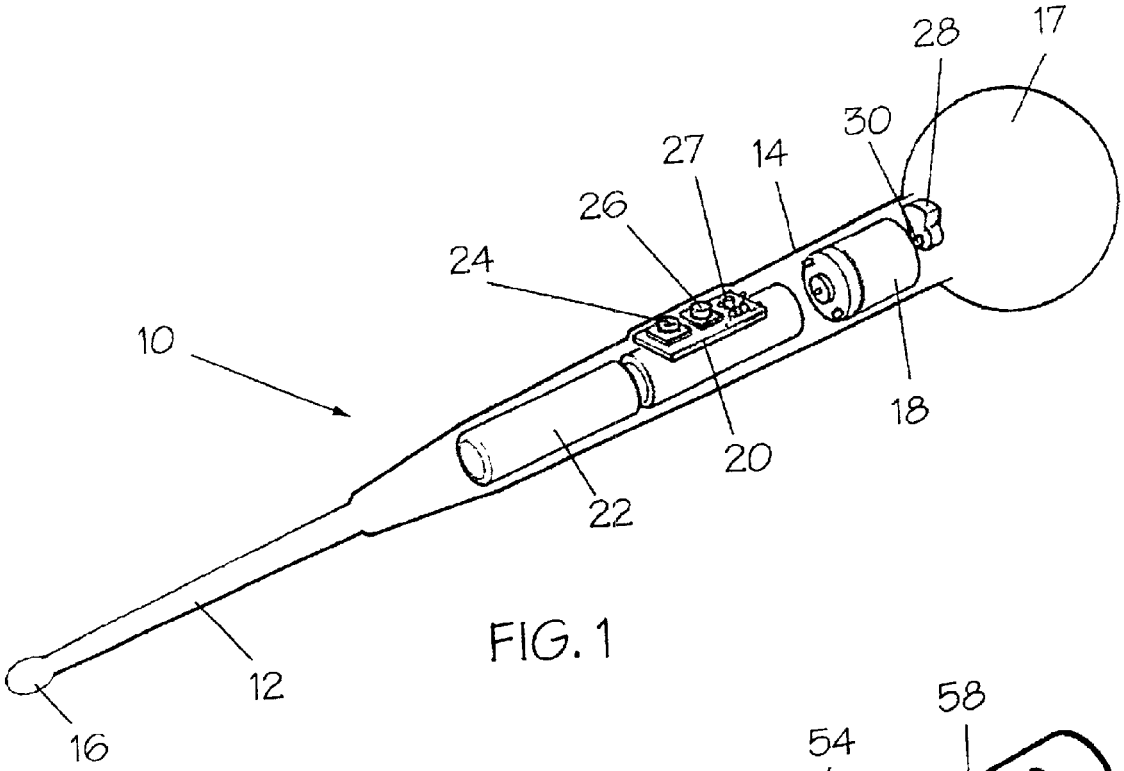
FIG. 1 is a perspective view of an embodiment of a drumstick of the present invention.

Referring to the drawings more particularly by reference numbers, FIG. 1 shows an embodiment of a drumstick 10 of the present invention. The drumstick 10 includes a rod 12 that is coupled to a handle 14. The rod 12 may include a tip 16. The handle 14 may include a tom tom end 17. The drumstick 10 may be operated by an end user to strike a surface with the tip 16 or tom tom 17. The surface may include, but is not limited to, a drum or a xylophone.

Located within the handle 14 is a motor 18. The motor 18 may be coupled to a printed circuit board assembly 20 and batteries 22. The printed circuit board assembly 20 may include an on/off switch 24 and a speed switch 26. The on/off switch 24 can be depressed to either turn on or turn off the motor 18. The speed switch 26 can be depressed to vary the speed of the motor 18. The printed circuit board assembly 20 may have various electrical circuits 27 that can perform the on/off and speed functions. Additionally, the printed circuit board assembly 20 may have circuits that automatically turn the motor 18 off if the drumstick is not used for a predetermined time interval. The handle 14 and rod 12 may be constructed from wood, plastic, metal or other material. The tom tom end 17 may be made from a foam or other soft material that will provide a more attenuated sound.

The drumstick 10 shown in FIG. 1 includes an off-center weight 28 that is attached to an output shaft 30 of the motor 18. Rotation of the off-center weight 28 will create a vibration in the handle 14. The vibration in the handle 14 will induce an oscillating movement (vibration) of the rod 12. When placed in contact with a surface the oscillating movement will emit a sound. The sound may be similar to a buzz roll of a drum. Additional sound effects can be generated by also striking the surface in a repetitive manner. For example, the drumstick can be used to "play" a drum set. The additional vibrational movement of the rod 12 will distort and vary the sound generated from the drums.

Figure 2:
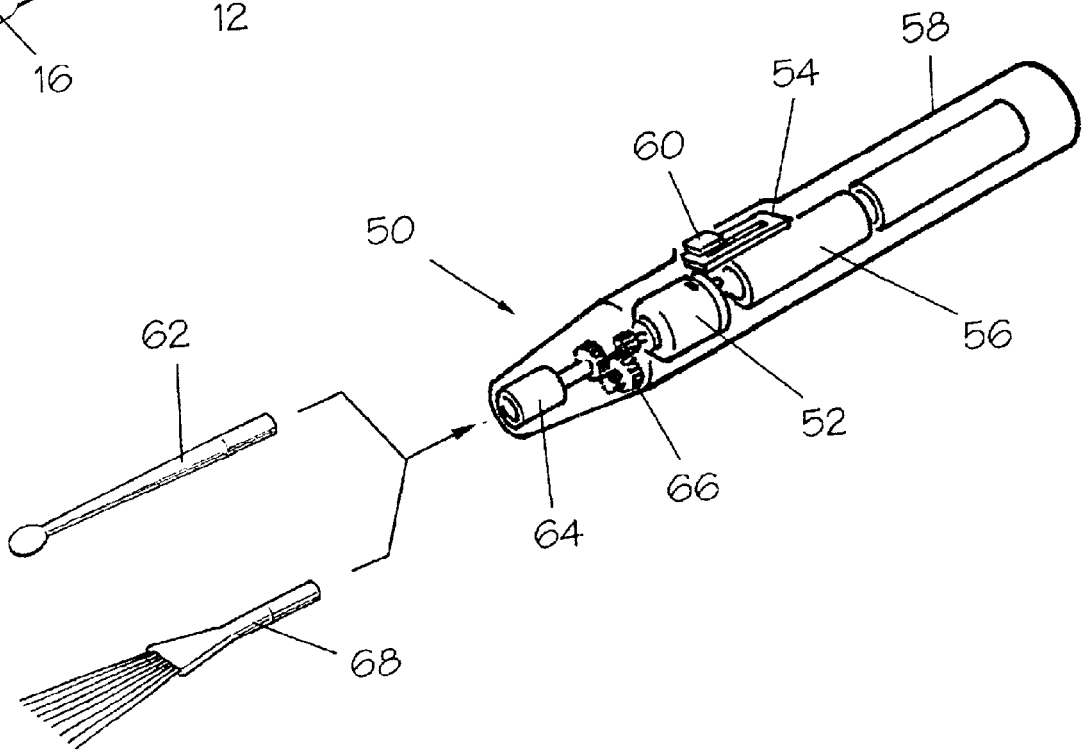
FIG. 2 is a perspective view of an alternate embodiment of the drumstick.

FIG. 2 shows an alternate embodiment of a drumstick 50. The drumstick 50 may include a motor 52, a printed circuit board assembly 54 and batteries 56 located within a handle 58. The printed circuit board assembly 54 may include a single switch 60 that performs the on/off and speed control functions.

Figure 3:
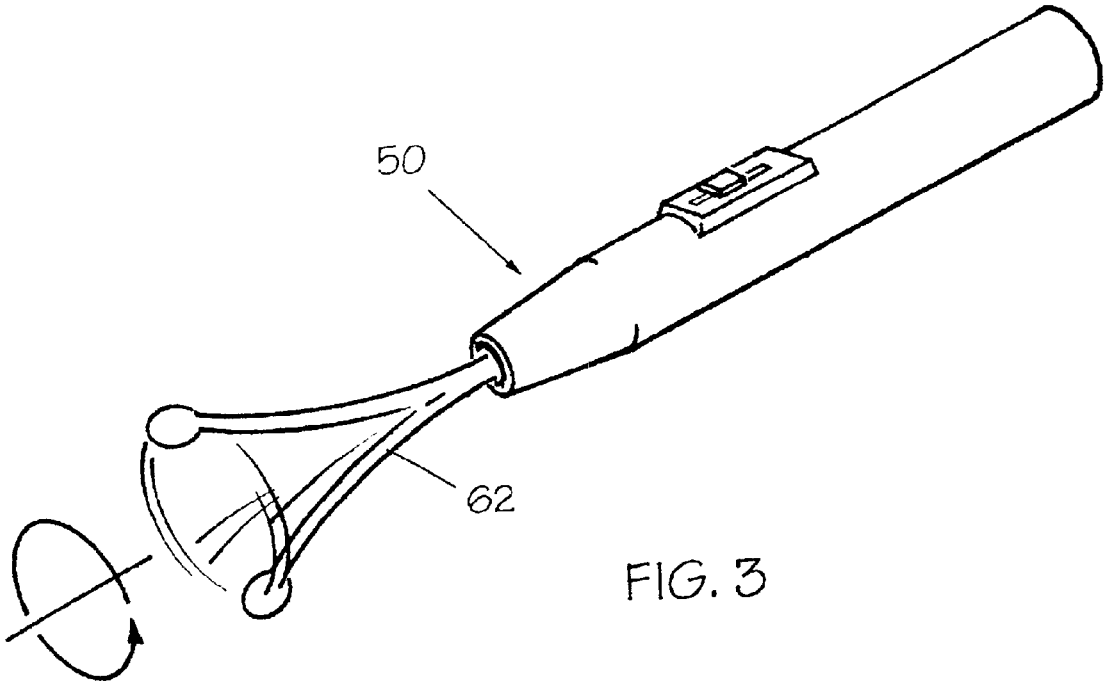
FIG. 3 is a perspective view showing a drumstick that can have either a tip or a brush.

The drumstick 50 may include a detachable rod 62 that can be plugged into a coupler 64. The coupler 64 may be coupled to the motor 52 by a gear train 66. As shown in FIG. 3, the rod 62 may bend while being rotated by the motor 52. The motor 52 will thus induce an oscillating movement of the rod 62. Like the embodiment shown in FIG. 1, the drumstick 50 can generate, and/or distort sound when placed into contact with a surface.

Referring again to FIG. 2, the rod 62 may be pulled out of the coupler 64 and replaced by a brush 68. Additionally, the embodiment shown in FIG. 1 may also have a coupler 64 that allows the drumstick 10 to have a rod 62 or brush 68.

Figure 4:
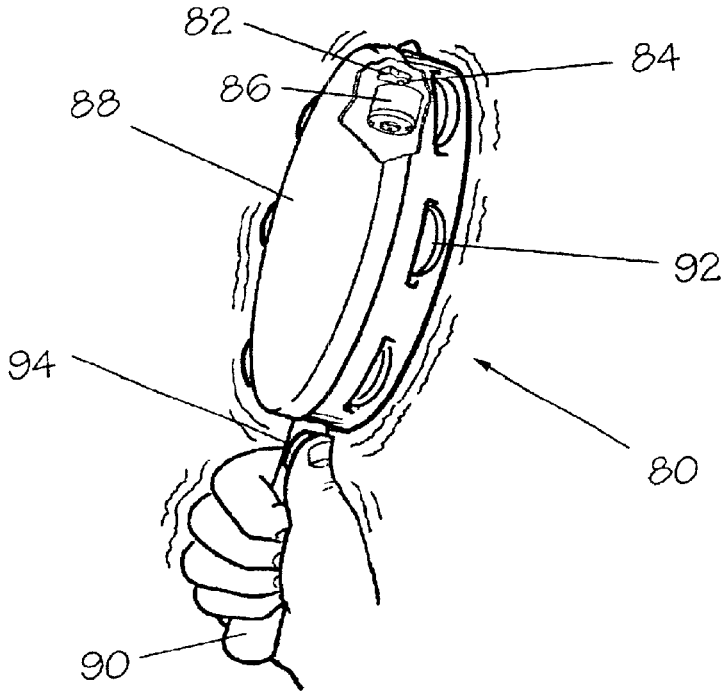
FIG. 4 is a perspective view showing a tambourine of the present invention.

FIG. 4 shows a tambourine 80 which has an off-center weight 82 attached to the output shaft 84 of the motor 86. The motor 86 and weight 82 are located in a drum 88 of the tambourine 80. The drum 88 is attached to a handle 90. The tambourine 80 may also have a plurality of metal disks 92. The motor 86 and weight 82 induce a vibration in the tambourine 80. The vibration may move the disks 92 and generate a sound. Additionally, the user can shake and pound the 80 tambourine as is known in the art. The motor 86 and weight 82 can vibrate the drum 88 and distort the sound emitted from the tambourine.

The tambourine 80 may have a switch 94 located on the handle 90. The end user can control the on/off and possibly the speed of the motor 86 through the switch 94. The tambourine 80 may further have batteries (not shown) and electronic circuits (not shown) located in the handle to control the motor 86.

Figure 5:
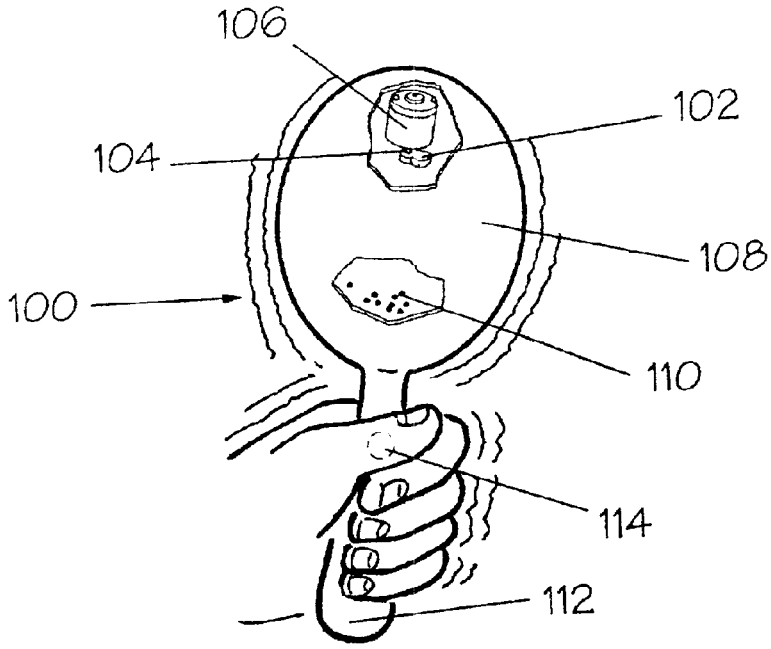
FIG. 5 is a perspective view showing a maraca of the present invention.

FIG. 5 shows a maraca 100 which has an off-center weight 102 attached to an output shaft 104 of a motor 106. The weight 102 and motor 106 are located within a shell 108. The shell 108 may be filled with beads 110.

The shell 108 may extend from a handle 112 that has a switch 114. The switch 114 may be connected to batteries (not shown) and electronic circuits (not shown) located in the handle 112. The switch 114 and circuit may control the activation and speed of the motor 106.

The end user can shake the beads 110 to emit a sound. The motor 106 and weight 102 may induce a vibration in the shell 108 that distorts the sound. Alternatively, the user may hold the maraca 100, wherein the vibration created by the weight 102 and motor 106 shake the beads 110 to generate sounds.

Figure 6:
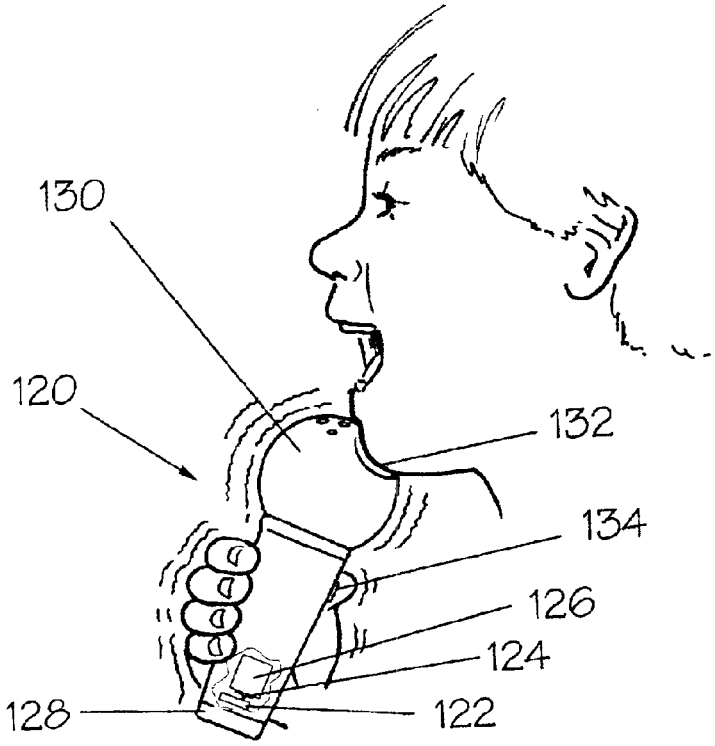
FIG. 6 is a perspective view showing a microphone of the present invention.

FIG. 6 shows a microphone 120 that includes an off-center weight 122 attached to the output shaft 124 of a motor 126. The weight 122 and motor 126 are located within a handle 128. The handle 128 may be attached to a transducer cover 130 that contains a microphone transducer (not shown). The cover 130 may have an indentation 132 that allows the user to place their chin against the microphone 130.

The handle 128 may have a switch 134 that is connected to batteries (not shown) and electronic circuits (not shown). The switch 134 and circuits may control the activation and speed of the motor 126. The switch 134 and circuits may also control the microphone transducer.

The user may input sound into the microphone 130, which may be audible vocal sounds like talking, singing or the like, wherein the motor 126 and weight 122 create a vibration that distorts the sound. The user may place their chin or other body part onto the microphone 130. The user may then input sound into the microphone 130, wherein the motor 126 and weight 122 create a vibration that distorts the sound.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, the electronic circuits in the drumstick and other musical devices shown may include memory and a processor that stores a program to generate output signals that the cause device to vibrate in a predetermined pattern. The vibrating pattern may create repeatable rhythmic patterns to create special sound and rhythmic rifts, etc. The musical devices may also include a speaker and other electronics to generate sound to accompany the sound generated by the vibrating device. By way of example, the speaker may generate the sounds of a keyboard, guitar, voice, etc. to create a musical tune, song or accompaniment, while the vibrating device provides the sound of the percussion. Additionally, although a drumstick, tambourine, maraca and microphone are described and shown, it is to be understood that the present invention may be used in other musical instruments.

What is claimed is:

1. A single drumstick for beating on a drum comprising:

a motor;

a circuit board assembly coupled to said motor;

a battery electrically connected to said motor and said circuit board assembly; and, drumstick housing, that has a rod at one end and that encloses said motor, said circuit board assembly and said battery, and which is oscillated by said motor.

2. The drumstick of claim 1, wherein said motor vibrates said drumstick housing.

3. The drumstick of claim 1, wherein said motor rotates said drumstick housing.

4. The drumstick of claim 1, further comprising an on/off switch coupled to said drumstick housing and said motor.

5. The drumstick of claim 1, further comprising a switch that is attached to said drumstick housing and can control a speed of said motor.

6. The drumstick of claim 8, further comprising a coupler that allows said rod to be detached from said handle.

7. The drumstick of claim 1, further comprising an off-center weight that is coupled to said motor and located within said drumstick housing.

8. The drumstick of claim 1, wherein said drumstick housing includes a handle coupled to said rod.

9. The drumstick of claim 1, further comprising a controller that controls said motor to create a rhythmic repeatable pattern.

10. The drumstick of claim 1, wherein said motor spins said drumstick housing rod.

* * * * *